US008609598B2

(12) United States Patent
Mikami et al.

(10) Patent No.: US 8,609,598 B2
(45) Date of Patent: Dec. 17, 2013

(54) GREASE COMPOSITION HAVING A BASE OIL, A THICKENER AND AN ADDITIVE INCLUDING A METAL SALT OF DIBASIC ACID

(75) Inventors: Hidenobu Mikami, Kuwana (JP); Takayuki Kawamura, Kuwana (JP); Mitsunari Asao, Kuwana (JP); Eiichirou Shimazu, Kuwana (JP)

(73) Assignee: NTN Corporation, Osaka (JP)

( * ) Notice: Subject to any disclaimer, the term of this patent is extended or adjusted under 35 U.S.C. 154(b) by 975 days.

(21) Appl. No.: 10/624,002

(22) Filed: Jul. 21, 2003

(65) Prior Publication Data

US 2004/0033911 A1 Feb. 19, 2004

(30) Foreign Application Priority Data

Aug. 2, 2002 (JP) ..... P2002-225725
Nov. 28, 2002 (JP) ..... P2002-345423

(51) Int. Cl.
*C10M 115/08* (2006.01)
*C10M 169/02* (2006.01)

(52) U.S. Cl.
USPC ..... 508/552; 508/511; 508/459

(58) Field of Classification Search
USPC ..... 508/511, 512, 552, 459, 469
See application file for complete search history.

(56) References Cited

U.S. PATENT DOCUMENTS 2,722,516 A * 11/1955 Merker ..... 508/512
3,867,399 A * 2/1975 Birke ..... 548/305.7
4,113,640 A * 9/1978 Wulfers ..... 508/258
5,301,923 A * 4/1994 Asao et al. ..... 508/410
5,498,357 A * 3/1996 Naka et al. ..... 508/176
5,707,944 A * 1/1998 Yokouchi et al. ..... 508/485
5,728,659 A * 3/1998 Naka et al. ..... 508/552
5,840,666 A * 11/1998 Yokouchi et al. ..... 508/291
5,851,969 A 12/1998 Andrew et al.
6,251,841 B1 * 6/2001 Koizumi et al. ..... 508/390
2002/0082175 A1 6/2002 Iso et al.

FOREIGN PATENT DOCUMENTS

FR 2 706 169 12/1994
JP 01-259097 10/1989
JP 01259097 A * 10/1989
JP 03-210394 9/1991
JP 06-200273 7/1994
JP 08176578 A * 7/1996
JP 10-273690 10/1998
JP 11-241087 9/1999
JP 11-256184 * 9/1999
JP 2000-192973 7/2000

(Continued)

OTHER PUBLICATIONS

Machine Translation of JP 11-256184 (1999).*

(Continued)

*Primary Examiner* — Jim Goloboy
(74) *Attorney, Agent, or Firm* — Hedman & Costigan, P.C.; James V. Costigan; Kathleen A. Costigan

(57) ABSTRACT

The present invention relates to a nitrite free grease composition having an oil base, a thickener, and several additives, including a metal salt of dibasic acid. The metal salt having sub-groups that can either be aliphatic or aromatic hydrocarbons. Additionally, the present invention relates to a grease-sealed bearing with a longer lifetime and excellent rust preventative properties.

7 Claims, 1 Drawing Sheet

(56) References Cited

FOREIGN PATENT DOCUMENTS

| | | |
|---|---|---|
| JP | 2001-234935 | 8/2001 |
| JP | 2001-342483 | 12/2001 |
| WO | WO 94/03565 | 2/1994 |

OTHER PUBLICATIONS

EPO Abstract for JP-06200273.*
EPO Search Report for EP 03254737.*
Patent Abstracts Japan vol. 018, No. 562 (c-1265) Oct. 27, 1994.

* cited by examiner

GREASE COMPOSITION HAVING A BASE OIL, A THICKENER AND AN ADDITIVE INCLUDING A METAL SALT OF DIBASIC ACID

BACKGROUND OF THE INVENTION

The present invention relates to a grease composition. More particularly, the present invention relates to a grease composition and a grease composition-sealed bearing for use in a ball-and-roller bearing built in automobile electric parts and accessories including an alternator, an electromagnetic clutch for an automobile air conditioner, a middle pulley, and an electric fan motor.

In the automobile industry, front engine and front driving (FF) automobiles have been widely used for reducing a size and a weight. Although a space for person in an automobile has been increased, and a space for an engine room has been inevitably decreased. Accordingly, automobile electric parts and accessories including an alternator, an electromagnetic clutch for an automobile air conditioner, a middle pulley, and an electric fan motor should have been small-sized and light-weighed. For example, a decrease in outputs of the small-sized alternator is compensated with a high-speed rotation of a rotor. In addition, whereby the engine room is tightly sealed to decrease a noise, resulting in high temperature in the engine room. It urges the parts to be withstand the high temperature.

The ball-and-roller bearing is built in the electric parts and accessories, and is mainly lubricated with a grease composition. It has been reported that when the electric parts and accessories are rotated at high speed and high temperature, a rolling surface of the ball-and-roller bearing is abnormally peeled, thereby shorting the lifetime of the bearing.

In order to avoid the abnormal peeling on the ball-and-roller bearing, Japanese Patent Laid-Open Application No. 3-210394 discloses a method of adding a passivation agent to a grease composition. International Publication No. WO94/03565 discloses a method of adding an antimony compound or a molybdenum compound to a grease composition to prolong a lifetime of a bearing.

However, it is known that a typical passivation agent, i.e., sodium nitrite, is reacted with a secondary amine under an acid condition to produce N-nitrosoamine. Since the nitrosoamine adversely affect the environment, it is not preferable. There are, however, no alternative materials.

Sodium nitrite also acts as a rust preventative, and is widely used in a grease composition for a ball-and-roller bearing used in automobile parts into which water is penetrated from a bottom of an automobile body during the automobile runs. Thus, an alternative of sodium nitrite is needed.

Other passivation agents, antimony compounds or molybdenum compounds including no sodium nitrite contain unfavorably heavy metals, which may adversely affect human bodies and the environment.

SUMMARY OF THE INVENTION

An object of the present invention is to provide a grease composition that has a prolonged lifetime at high temperature, does not adversely affect human bodies and the environment, and provides a ball-and-roller bearing with a longer lifetime and excellent rust preventative properties, and a grease sealed bearing sealed with this grease composition.

The grease composition according to the present invention comprises a base oil, a thickener, and an additive, wherein the base oil has a kinetic viscosity of 20 to 150 $mm^2/s$ at 40° C., and wherein the additive contains as an essential component 0.05 to 10 parts by weight of a metal salt of a dibasic acid based on 100 parts by weight of the base oil and the thickener, the metal salt of the dibasic acid being represented by the following formula:

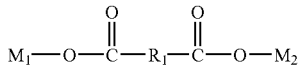

(1)

where $M_1$ and $M_2$ represent the same or different alkali metal, and $R_1$ represents aliphatic hydrocarbon group or an aromatic hydrocarbon group.

The base oil of the grease composition according to the present invention contains alkyldiphenyl ether oil.

The thickener of the grease composition according to the present invention is an urea-based thickener, and is contained in an amount of 5 to 30% by weight based on the total amount of the base oil and the thickener.

The urea thickener is an aromatic diurea compound represented by the following formula (2)

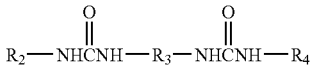

(2)

where $R_2$ and $R_4$ are the same or different, and represent each an aromatic hydrocarbon group having 6 to 15 carbon atoms, and $R_3$ represents an aromatic hydrocarbon group having 6 to 15 carbon atoms.

The additive comprises 0.05 to 5 parts by weight of an antioxidant in addition to the metal salt of the dibasic acid based on 100 parts by weight of the base oil and the thickener.

The grease composition sealed bearing of the present invention has a sliding part of the bearing sealed with the grease composition of the present invention.

The present invention is based on such a discovery that a lubricating lifetime of the grease composition at high temperature and a lifetime of the ball-and-roller bearing can be significantly improved by adding the metal salt of the dibasic acid to the grease composition, and that rust preventative properties of the grease can be significantly improved without adding sodium nitrite.

DETAILED DESCRIPTION OF THE PREFERRED EMBODIMENTS

Figure 1:
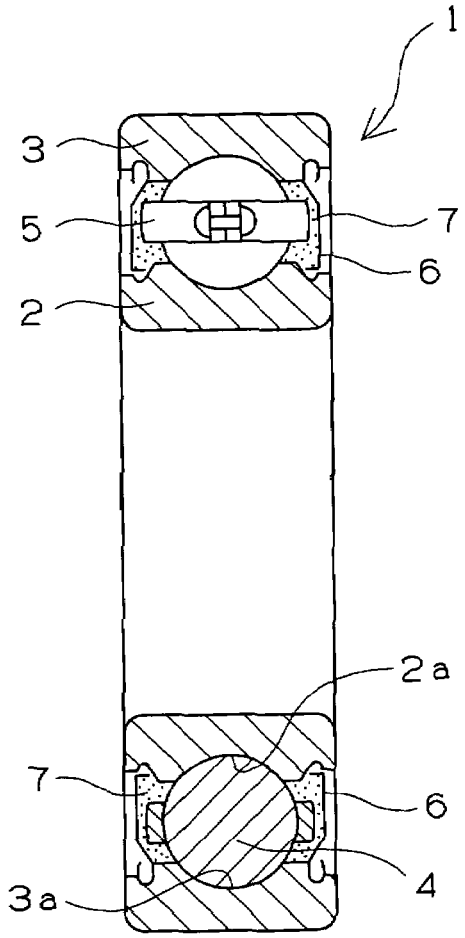
FIG. 1 is a sectional view showing an example of a deep groove ball-and-roller bearing.

The base oil for use in the present invention can be any base oil that has kinetic viscosity of 20 to 150 $mm^2/s$ at 40° C., and preferably 50 to 100 $mm^2/s$. If the kinetic viscosity is less than 20 $mm^2/s$, the base oil has insufficient heat resistance. On the other hand, if the kinetic viscosity exceeds 150 $mm^2/s$, a heat is excessively generated by rotation, which is unfavorable.

Examples of the base oil having the kinetic viscosity defined above include mineral oils, synthesized oils and a mixture thereof that are generally used for the grease composition.

Examples of the mineral oils are a paraffin-based mineral oil and a naphthene-based oil.

Examples of the synthesized oils include synthesized hydrocarbon oils, ether oils and ester oils. Specific examples of the ether oils include alkyldiphenyl ether oils, alkyltriphenyl ether oils, and alkyltetraphenyl ether oils. Specific examples of the ester oils include diester oils, polyolester oils, or complex ester oils thereof, and aromatic ester oils.

Of these, the base oil containing the alkyldiphenyl ether oil having excellent lubricating properties at high temperature and at high speed, and prolonged lubricating lifetime is preferable. The base oil may be alkyldiphenyl ether oil alone, or may be a mixture of alkyldiphenyl ether oil and other synthesized oils or mineral oils. In the case of the mixture base oil, at least 20% by weight, preferably 60% by weight or more of alkyldiphenyl ether oil is contained in the base oil, in order to provide excellent lubricating properties and prolonged lifetime.

Specifically, the alkyldiphenyl ether oil is the monoalkyldiphenyl ether oil represented by the following formula (3) and/or the dialkyldiphenyl ether oil represented by the following formula (4):

(3)

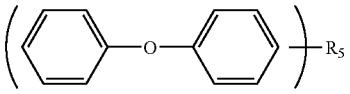

(4)

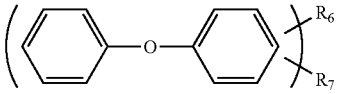

where each of $R_5$, $R_6$ and $R_7$ is an alkyl side chain having 8 to 20 carbon atoms, and is bonded to one phenyl ring or two phenyl rings.

Of these, the dialkyldiphenyl ether oil having the alkyl side chains $R_6$ and $R_7$ is preferable, with taking heat resistance and evaporation properties into consideration.

The base oil containing the alkyldiphenyl ether oil also has a kinetic viscosity of 20 to 150 $mm^2/s$ at 40° C.

The metal salt of the dibasic acid represented by the formula (1) that is added as the essential component to the grease composition can be metal salts of aliphatic or aromatic dibasic acids. Examples of the dibasic acids include malonic acid, methyl malonic acid, succinic acid, methyl succinic acid, dimethyl malonic acid, ethyl malonic acid, glutaric acid, adipic acid, dimethyl succinic acid, pimelic acid, tetramethyl succinic acid, suberic acid, azelaic acid, sebacic acid, brassylic acid, phthalic acid and the like. Preferable metal constituting the metal salts is a monovalent metal of an alkali metal such as lithium, sodium, potassium and the like.

In the metal salt of the dibasic acid represented by the formula (1), $M_1$ and $M_2$ may be the same alkali metal, or different kinds of alkali metals.

Preferably, $M_1$ and $M_2$ are the same alkali metal in the metal salt of the dibasic acid represented by the formula (I). Examples of such metal salt of the dibasic acid include sodium azelate, sodium sebacate, sodium adipate, and potassium sebacate. Sodium sebacte is more preferable, since rust preventative, porpotions and lubricating lifetime at high temperature of the grease can be significantly improved without sodium nitrite.

The metal salt of the dibasic acid represented by the formula (1) is contained in amount of 0.05 parts to 10 parts by weight, preferably 0.5 parts to 5 parts by weight based on 100 parts of the base oil and the thickener. If the metal salt of the dibasic acid is contained in amount of less than 0.05 parts by weight, no effect is provided. If the metal salt of the dibasic acid is contained in amount of more than 10 parts by weight, it is gelled and unusable.

The thickener for use in the present invention can be any thickener used in conventional grease compositions. Examples include a metallic soap, a compound soap, a urea compound, organic bentonite, silica and the like.

Examples of the metallic soap include 12-hydroxy lithium stearate, lithium stearate, a lithium complex and the like. Examples of the urea compound include aliphatic diurea, alicyclic diurea, aromatic diurea, triurea, tetraurea, urea urethane and the like. Examples of the aromatic bentonite include montmorillonite treated with a quaternary ammonium salt and the like. Examples of the silica include ultrafine silica powder produced by a gas phase reaction, the ultrafine silica powder treated with a lower alcohol such as methane, as well as a sulfonate complex, tetrafluoroethylene resin powder and the like.

Preferably, the thickener is the urea compound having high heat resistance properties. More preferably, the thickener is the aromatic diurea compound represented by the formula (2).

In the aromatic diurea compound represented by the following formula (2), each of $R_2$ and $R_4$ an aromatic hydrocarbon group having 6 to 15 carbon atoms, and may the same or different. If the numbers of carbon atoms are less than 6, the thickener has poor heat resistance. If the numbers of carbon atoms are more than 15, the grease has poor thickening properties. Examples of the $R_2$ and $R_4$ include a phenyl group, a tolyl group, a xylyl group, t-butylphenyl group, a benzyl group and the like.

In the formula (2), $R_3$ represents an aromatic hydrocarbon group having 6 to 15 carbon atoms. If the numbers of carbon atoms are less than 6, the grease has poor thickening properties. If the numbers of carbon atoms are more than 15, the grease is easily hardened. Examples of the $R_3$ include an aromatic single ring, an aromatic fused ring, and a group obtained by linking these rings with a methylene chain, a cyanuric ring, an isocyanuric ring and the like. Preferably, the aromatic hydrocarbon group is represented by the following formulas (5):

(5)

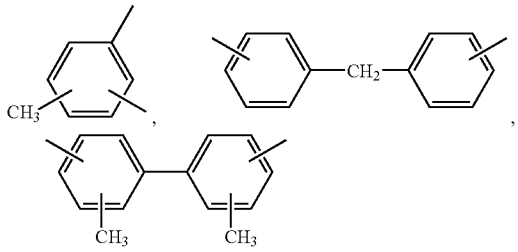

Of these, particularly preferable group is represented by the following formulas (6):

(6)

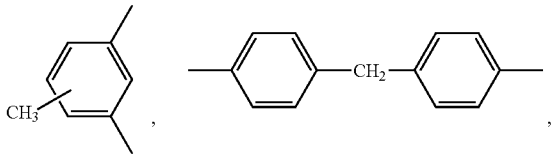

-continued

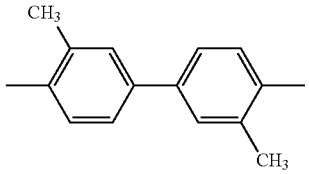

The aromatic diurea compound is used as the thickener, whereby the grease composition has improved heat resistance.

The aromatic urea thickener is obtainable by reacting an isocyanate compound with an amino compound. It is preferable that an isocyanate group of the isocyanate compound and an amino group of the amino compound be approximately equivalent in order not to leave reactive free radicals.

The grease composition may be prepared by reacting the isocyanate compound with the amino compound in the base oil, or by mixing the urea compound synthesized in advance with the base oil. The former is preferable since the stability of the grease composition is easily kept.

The urea-based thickener is contained in amount of 5% to 30% by weight based on the total amount of the grease. If the amount of the urea-based thickener is less than 5% by weight, the grease composition becomes liquid with low viscosity. Such grease composition is easily leaked so that the bearing is hardly sealed. On the other hand, if the amount of the urea-based thickener exceeds 30% by weight, the grease composition is solidified, and consistency becomes 200 or less, resulting in an unusable grease composition for sealing the bearing.

The grease composition of the present invention comprises the base oil, the thickener, and the metal salt of the dibasic acid as the essential components as described above. In addition, the grease composition may comprise additives such as an extreme pressure agent, an antioxidant, a rust preventative, a metal deactivator, and an oily agent that are conventionally added to the grease.

By adding the extreme pressure agent to the grease composition, load resistance and extreme pressure properties can be improved. For example, the compounds described below can be used. Examples of the extreme pressure agent in an organic metal type include an organic zinc compound such as zinc dithiocarbamate, zinc dithiophosphate, and zinc phenate; an organic selenium compound such as selenium dithiocarbamate; an organic bismuth compound such as bismuth naphthenate, and bismuth dithiocarbamate; an organic iron compound such as iron dithiocarbamate and iron octylate; an organic copper compound such as copper dithiocarbamate and copper naphthenate; an organic lead compound such as lead naphthenate, and lead dithiocarbamate; an organic tin compound such as tin maleate, and dibutyltin sulfide. Also, an organic sulfonate, phenate, phosphate of an alkali metal or an alkali earth metal; or an organic metal compound of gold, silver, titanium, cadmium can be used as required. Examples of the extreme pressure agent in a sulfur type include a sulfide or polysulfide compound such as dibenzyldisulfide; sulfurized oil; a non-ash type carbamate compound; a thiourea compound; a thiocarponate and the like. Examples of the extreme pressure agent in a phosphoric acid type include a phosphoric acid ester such as trioctylphosphate, and tricresylphosphate; a phosphoric acid ester-based compound such as acidic phosphoric acid ester, phosphorous acid ester, and acidic phosphorous acid ester. Also, there can be used a halogen-based extreme pressure agent such as chlorinated paraffin; and a solid lubricant such as molybdenum disulfide, tungsten disulfide, graphite, polytetrafluoroethylene, antimony sulfide, and a boron compound such as boron nitride. Of these, the dithiocarmic acid-based compound and the dithiophosphoric acid-based compound are preferable.

As the antioxidant, there can be used an age resistor, an antiozonant, and an oxidation inhibitor that are added to rubber, plastic, and a lubricant, by selecting suitable one as required. Specific examples include an amine-based compound such as phenyl-1-naphtylamine, phenyl-2-naphtylamine, diphenyl-p-phenylenediamine, dipyridylamine, p,p-dioctyldiphenylamine, N,N-diisopropyl-p-phenylenediamine, and N,N-di-sec-butyl-p-phenylenediamine.

Preferably, a sulfur-containing antioxidant, and a phenol-based antioxidant can use used. Examples of the sulfur-containing antioxidant include alkyl dithio phosphate, dilauryl thiodipropionate, distearylthiodipropionate, dimyristylthiodipropionate, ditridecylthiodipropionate, phenothiazine, N-methylphenothiazine, N-ethylphenothiazine, and 3,7-dioctylphenothiazine.

Examples of the phenol-based antioxidant include 2,6-di-tert-butylphenol, n-octadecyl-3-(3',5'-di-tert-butyl-4-hydroxyphenyl)propionate, tetrakis-(methylene-3-(3',5'-di-tert-butyl-4-hydroxyphenyl)propionate)methane, 2,2'-methylenebis-(4-methyl-6-tert-butylphenol), and 4,4'-buthylidenebis-(3-methyl-6-tert-butylphenol).

Examples of the rust preventative include an ammonium salt of an organic sulfonic acid; an alkali metal such as barium, zinc, calcium, and magnesium; an organic sulfonic acid salt of an alkali earth metal; an organic carboxylic acid salt; phenate; phosphonate; an alkyl or an alkenyl succinic acid derivative such as an alkyl or an alkenyl succinic acid ester; a partially esterified multivalent alcohol such as sorbitanmonooleate; hydroxyl fatty acids such as oleoylsarcosine; mercapto fatty acids such as 1-mercapto stearic acid or metal salts thereof; higher fatty acids such as stearic acid; higher alcohol such as isostearyl alcohol; an ester of a higher alcohol and a higher fatty acid; thiazoles such as 2,5-dimercapto-1,3,4-thiadiazole, and 2-mercaptothiadiazole; an imidazole compound such as 2-(decyldithio)-benzimidazole and benzimidazole; a phosphoric acid ester such as trisnonylphenylphosphite; a thiocarboxylic acid ester compound such as dilaurylthiopropionate.

Examples of the metal inactivator include a triazole compound such as benzotriazole and tolyltriazole.

Examples of the oily agent include a fatty acid such as oleic acid and stearic acid; a fatty acid alcohol such as oleyl alcohol; a fatty acid ester such as polyoxyethylene stearic acid ester and polyglyceryloleic acid ester; phosphoric acid; a phosphoric acid ester such as tricresyl phosphate, lauryl acid ester and polyoxyethylene oleyl ether.

FIG. 1 shows an example of a grease composition sealed bearing according to the present invention, and is a sectional view of a deep groove ball bearing.

The grease composition sealed bearing 1 comprises an inner ring 2 having an inner ring rolling surface 2*a* on an outer perimeter, an outer ring having an outer ring rolling surface 3*a* on an inside perimeter, and a plurality of rolling elements 4 disposed between the inner ring rolling surface 2*a* and the outer ring rolling surface 3*a*.

The grease composition sealed bearing 1 is environmentally-benign, since the grease composition 7 uses the additive containing no nitrite. Also, the grease composition sealed bearing 1 has excellent rust preventative properties, and can be suitably used in a ball-and-roller bearing built in automobile electric parts and accessories including an alternator, an electromagnetic clutch for an automobile air conditioner, a middle pulley, and an electric fan motor.

EXAMPLE 1

A base oil was prepared by mixing poly-α-olefine oil (commercially available under the trade name of "Shinfluid 601" from Nippon Steel Chemical Co., Ltd.) and alkyldiphenyl ether oil (commercially available under the trade name of "LB100" from Matsumura Sekiyu:KK)in the ratio shown in Table 1. The base oil is separated into two liquids. 4,4'-diphenyl methane diisocyanate was dissolved into the first half of the liquids, and p-toluidine in amount of two equivalent weight of 4,4'-diphenyl methane diisocyanate was dissolved into the second half of the liqudis. 4,4'-diphenyl methane diisocyanate was added as an aromatic diurea compound in an amount shown in Table 1. While the first half solution in which 4,4'-diphenyl methane diisocyanate was dissolved was stirred, the second half solution in which p-toluidine was dissolved was added to the first half solution. The mixed solution was stirred at 100 to 120° C. for 30 minutes, whereby the aromatic diurea compound was mixed with the base oil. Sorbitantorioleate, sodium sebacate and an antioxidant were added thereto in amount shown in Table 1, and stirred at 100 to 120° C. for 10 minutes. After cooling, the mixed solution was homogenized using three-rolls to provide a grease composition.

The thus-obtained grease composition was evaluated using a high temperature and high speed test, a quick acceleration and deceleration test and rust preventative test. The results are also shown in Table 1.

High Temperature and High Speed Test

A ball-and-roller bearing (6204) was sealed with 0.7 g of grease to be tested, rotated at 10000 rpm, at an outer diameter temperature of an outer ring of the bearing of 150° C. under a radial load of 67 N and an axial load of 67 N. A time to seizure was measured. The results are also shown in Table 1.

Quick Acceleration and Deceleration Test

A quick acceleration and deceleration test was conducted on a ball-and-roller bearing that supported a rotating shaft with an inner ring; the rotating shaft supporting a pulley around which a rotating belt of an alternator was wound; the alternator being one example of electrical auxiliary equipment. Operation conditions of the quick acceleration and deceleration test were set as follows: a load of 3234 N to the pulley, and a rotating speed of 0 to 18000 rpm. An endurable time (life time) was measured, which was the time to produce abnormal peeling within the bearing, to detect higher vibration than a set value by an oscillation detector, and finally to stop a generator. The results are also shown in Table 1.

Rust Preventative Test

A rust preventative test was conducted in accordance with, but under more severe test conditions than, the method set forth in ASTM D 1743. A conical roller bearing "30204" was degreased with an organic solvent, and dried in advance. The bearing was sealed with 1.9 to 2.1 g of the grease composition being tested. 98N of an axial load was applied to the bearing. Running-in was performed for 1 minute at 1800 rotations per minute. Thereafter, the bearing was dipped with 1% by weight of saline solution, was introduced into a sealed high humid vessel where it reaches a saturated vapor pressure at 40° C., and allowed to stand for 48 hours at 40° C. Rust generation was observed and determined. An outer ring of the bearing was divided into 32 portions to count the numbers of the portions where rust was generated. Results are presented as the average of four tests, and also shown in Table 1.

EXAMPLES 2 to 8

In each example, a thickener and a base oil were selected in a ratio shown in Table 1 to prepare a base grease in a manner similar to Example 1. To the base grease, an additive was added to provide a grease composition. In Example 3, 4, 6 or 8, the base oil was constituted only with an alkyldiphenyl ether oil. The resultant grease compositions were tested for the above-mentioned tests in a manner similar to Example 1. The results are also shown in Table 1.

COMPARATIVE EXAMPLES 1 TO 4

In each Comparative Example, a thickener and a base oil were selected in a ratio shown in Table 2 to prepare a base grease in a manner similar to Example 1. To the base grease, an additive was added to provide a grease composition. The resultant grease compositions were tested for the above-mentioned tests in a manner similar to Example 1. The results are shown in Table 2.

TABLE 1

| | Example | | | | | | | |
|---|---|---|---|---|---|---|---|---|
| | 1 | 2 | 3 | 4 | 5 | 6 | 7 | 8 |
| Component (parts by weight) | | | | | | | | |
| Base oil | | | | | | | | |
| Synthesized hydrocarbon oil*1) | 16 | 16 | — | — | 16 | — | 16 | — |
| Alkyldiphenyl ether oil*2) | 64 | 64 | 80 | 80 | 64 | 80 | 64 | 80 |
| Thickener | | | | | | | | |
| Amine, p-toluidine | 9.3 | 9.3 | 9.3 | 9.3 | 9.3 | 9.3 | 9.3 | 9.3 |
| Diisocyanate, MDI*3) | 10.7 | 10.7 | 10.7 | 10.7 | 10.7 | 10.7 | 10.7 | 10.7 |
| Additives | | | | | | | | |
| Ba sulfonate | — | 1 | — | 1 | — | 1 | — | 1 |
| Sorbitanester*4) | 1 | — | 1 | — | 1 | — | 1 | — |
| Metal salt of dibasic acid (Na sebacate) | 1 | 1 | 1 | 1 | 1 | 1 | 1 | 1 |
| Antioxidant | | | | | | | | |
| Alkylated diphenylamine | 2 | 2 | 2 | 2 | — | — | — | — |
| Dilaurylthiodipropionate | — | — | — | — | 2 | 2 | 2 | 2 |
| Tetrakis-(methylene-3-(3',5'-di-t-butyl-4-hydroxyphenyl)propionate)methane | — | — | — | — | — | — | 1 | 1 |

TABLE 1-continued

| | Example | | | | | | | |
|---|---|---|---|---|---|---|---|---|
| | 1 | 2 | 3 | 4 | 5 | 6 | 7 | 8 |
| Properties | | | | | | | | |
| Viscosity of base oil (40° C., $mm^2/s$) | 72 | 72 | 97 | 97 | 72 | 97 | 72 | 97 |
| Worked penetration (JIS K2220) | 286 | 264 | 292 | 288 | 288 | 300 | 284 | 298 |
| High temperature and high speed test, h | 1200 | 1000 | 1600 | 1400 | 2200 | 2600 | 2900 | 3000 |
| Quick acceleration and deceleration test, h | >300 | >300 | >300 | >300 | >300 | >300 | >300 | >300 |
| Rust preventative properties, number | 3 | 1 | 5 | 2 | 1 | 4 | 0 | 5 |

*1)"Shinfluid 601" from Nippon Steel Chemical Co., Ltd.
*2)"LB100" from Matsumura Sekiyu: KK
*3)diphenylmethandiisocyanate
*4)sorbitantrioleate

TABLE 2

| | Comparative Example | | | |
|---|---|---|---|---|
| | 1 | 2 | 3 | 4 |
| Component (parts by weight) | | | | |
| Base oil | | | | |
| Synthesized hydrocarbon oil*1) | 16 | 16 | 16 | — |
| Alkyldiphenyl ether oil*2) | 64 | 64 | 64 | 80 |
| Thickener | | | | |
| Amine, p-toluidine | 9.3 | 9.3 | 9.3 | 9.3 |
| Diisocyanate, MDI*3) | 10.7 | 10.7 | 10.7 | 10.7 |
| Additives | | | | |
| Ba sulfonate | 1 | 1 | — | 1 |
| Sorbitanester*4) | 1 | — | 1 | 1 |
| Metal salt of dibasic acid (Na sebacate) | — | — | — | — |
| Antioxidant | | | | |
| Alkylated diphenylamine | 2 | 2 | 2 | 2 |
| Dilaurylthiodipropionate | — | — | — | — |
| Tetrakis-(methylene-3-(3',5'-di-t-butyl-4-hydroxyphenyl)propionate)methane | — | — | — | — |
| Properties | | | | |
| Viscosity of base oil (40° C., $mm^2/s$) | 72 | 72 | 72 | 97 |
| Worked penetration (JIS K2220) | 272 | 270 | 280 | 282 |
| High temperature and high speed test, h | 250 | 600 | 600 | 800 |
| Quick acceleration and deceleration test, h | 130 | 250 | 220 | 180 |
| Rust preventative properties, number | 0 | 18 | 22 | 1 |

*1)"Shinfluid 601" from Nippon Steel Chemical Co., Ltd.
*2)"LB100" from Matsumura Sekiyu: KK
*3)diphenylmethandiisocyanate
*4)sorbitantrioleate As apparent from the results shown in Tables 1 and 2, the grease compositions according to the present invention provide excellent results in all of the high temperature and high speed test, the quick acceleration and deceleration test and the rust preventative test.

In the grease composition according to the present invention, the base oil has a kinetic viscosity of 20 to 150 $mm^2/s$ at 40° C., and the additive contains as an essential component 0.05 to 10 parts by weight of a metal salt of a dibasic acid based on 100 parts by weight of the base oil and the thickener. The grease composition of the present invention does not adversely affect human bodies and the environment, and provides satisfactory results in all of the high temperature and high speed test, the quick acceleration and deceleration test and the rust preventative test.

Since the base oil contains alkyldiphenylether oil, and the thickener is the urea-based thickener, i.e., the aromatic diurea compound represented by the following formula (2) in the grease composition of the present invention, excellent results are obtained in all of the high temperature and high speed test, the quick acceleration and deceleration test and the rust preventative test.

Since the additive contains as an essential component 0.05 to 10 parts by weight of a metal salt of a dibasic acid based on 100 parts by weight of the base oil and the thickener in the grease composition of the present invention, excellent results are obtained in all of the high temperature and high speed test, the quick acceleration and deceleration test and the rust preventative test.

Since the grease composition sealed bearing according to the present invention is sealed with the above-mentioned grease composition of the present invention, excellent results are obtained in all of the high temperature and high speed test, the quick acceleration and deceleration test and the rust preventative test.

What is claimed is:

1. A nitrate free grease composition for avoiding an abnormal peeling of a rolling surface of a bearing, said nitrate free grease composition comprising:

a base oil, a thickener, and an additive, wherein the base oil consists of symthesized hydrocarbon oil and 20% by weight or more of alkyldiphenyl ether oil or consists of alkyldiphenyl ether oil, and has a kinetic viscosity of 20 to 150 $mm^2/s$ at 40 degree° C., and wherein the thickener is an aromatic diurea compound represented by the following formula (2)

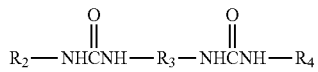

(2)

where R2 and R4 are the same or different, and represent each an aromatic hydrocarbon group having 6 to 15 carbon atoms, and R3 represents an aromatic hydrocarbon group having 6 to 15 carbon atoms, and is contained in an amount of 5 to 30% by weight based on the total amount of the base oil and the thickener, and wherein the additive contains as an essential component 1 to 3 parts by weight of a sodium sebacate based on 100 parts by weight of the base oil and the thickener, wherein the additive contains a rust preventative which is a partially esterified multivalent alcohol or an organic sulfonic acid salt of an alkali metal or an alkali earth metal.

2. The grease composition as claimed in claim 1, wherein each of the $R_2$ and $R_4$ is $C_6H_4(CH_3)$, and the $R_3$ is represented by the following formula

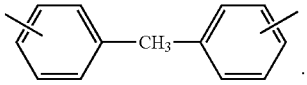

3. The grease composition as claimed in claim 1, wherein the additive comprises 0.05 to 5 parts by weight of an antioxidant in addition to sodium sebacate based on 100 parts by weight of the base oil and the thickener.

4. The grease composition as claimed in claim 3, wherein the antioxidant is selected from the group consisting of a sulfur-containing antioxidant, a phenol-based antioxidant and an amine-based antioxidant.

5. A grease composition sealed bearing, in which a sliding part of the bearing is sealed with the grease composition as claimed in claim 1.

6. The grease composition as claimed in claim 1, wherein said synthesized hydrocarbon oil is a poly-α-olefin Oil and said alkyldiphenyl ether oil is dialkyldiphenyl ether oil.

7. The grease composition as claimed in claim 1, wherein the thickener is contained in an amount of 18 to 22% by weight based on the total amount of the base oil and the thickener.

* * * * *